United States Patent [19]

Bailey

[11] Patent Number: 4,804,026

[45] Date of Patent: Feb. 14, 1989

[54] SELF-SUPPORTING FUNNEL

[76] Inventor: Thomas F. Bailey, 200 W. Bolivar Ave., Milwaukee, Wis. 53207

[21] Appl. No.: 155,989

[22] Filed: Feb. 16, 1988

[51] Int. Cl.[4] ..... B65B 39/02; B67C 11/00

[52] U.S. Cl. ..... 141/340

[58] Field of Search ..... 141/340, 341–343

[56] References Cited

U.S. PATENT DOCUMENTS

| | | | |
|---|---|---|---|
| 474,036 | 5/1892 | Wood | 141/340 |
| 502,622 | 8/1893 | Goldsmith | 141/340 |
| 1,302,086 | 4/1919 | Pitlick | 141/340 |

FOREIGN PATENT DOCUMENTS

| | | | |
|---|---|---|---|
| 471333 | 2/1951 | Canada | 141/340 |
| 22525 | of 1895 | United Kingdom | 141/340 |

*Primary Examiner*—William A. Cuchlinski, Jr.
*Attorney, Agent, or Firm*—Ronald E. Barry

[57] ABSTRACT

A funnel including a conical body having a spout formed at the narrow end of said body and three straps equaly spaced around the periphery of the body and connected to the top of the body and the bottom of the spout so that the strap is spaced outwardly from the body and spout throughout the full length of the strap, and each strap including a number of equally spaced notches to support the funnel in a vertical relation to an angularly disposed neck of a tank or container.

5 Claims, 1 Drawing Sheet

SELF-SUPPORTING FUNNEL

BACKGROUND OF THE INVENTION

1. Field of the Invention

This invention relates to funnels and more particularly to a self-supporting type funnel.

2. Description of the Invention

Funnels typically include a conical shaped upper portion having a tubular neck section at the narrow end. The funnel is placed in the neck or opening at the top of the bottle. Due to the variation in diameter of the openings in the bottle, the funnel has a tendency to tip to one side or the other when left in the opening. Efforts to overcome this problem have been mainly directed to the use of straps of varying diameters which are inserted into the opening shown in U.S. Pat. No. 1,868,389 or bars having increasing diameters for mounting on the outside of the neck of the bottle as shown in U.S. Pat. No. 2,703,670. Neither of these prior art patents have solved the problem of providing support for any size opening in the neck of the bottle. A further problem is encountered when the neck of the tank or bottle is offset from the vertical axis such as a gasoline tank. None of the prior discloses a funnel support that will hold a funnel in a generally vertical relation to an angular offset opening.

SUMMARY OF THE INVENTION

A principal feature of the invention is the provision of a unitary or one-piece type funnel having integral supporting straps. This construction is simpler than known constructions and provides a more effective support for the funnel.

Another principal feature of the invention is the provision of straps on a funnel which are readily adaptable to firmly engage any size opening.

A further feature of the invention is the provision of notches on the strap which mechanically interlock with the opening in the bottle to positively locate the funnel in the opening.

Other principal features and advantages of the invention will become apparent to those skilled in the art upon review of the following detailed description, claims and drawings.

THE DETAILED DESCRIPTION OF THE DRAWING

Figure 2:
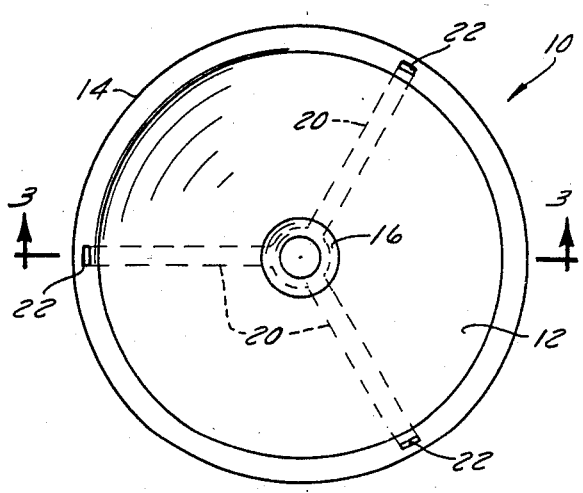
FIG. 2 is a top view of the funnel.

Before one embodiment of the invention is explained in detail, it is to be understood that the invention is not limited in its application to the details of construction and the arrangements of components set forth in the following description or illustrated in the drawings. The invention is capable of other embodiments that are being practiced or being carried out in various ways. Also, it is to be understood that the phraseology and terminology used herein is for the purpose of description and should not be regarded as limiting.

THE DETAILED DESCRIPTION OF THE INVENTION

The funnel 10 as disclosed herein may be formed of metal, plastic or any other suitable material, and made by stamping, bending, molding or other appropriate operations. However, the funnel preferably will be formed of molded plastic and as a one-piece or integral unit and is described herein by way of illustration and not by way of limitation.

The funnel 10 includes a main body section 12 of a hollow conical configuration having a radially, outwardly projecting flange 14 at the upper end and a tubular or neck section 16 at the small end of the body 12. The spout or neck 16 extends into the neck or opening of a bottle 18. The axis of the funnel normally being located coaxially with the neck 18 of a tank or bottle 19.

Figure 1:
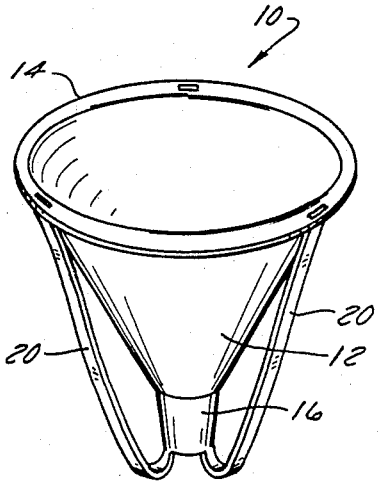
FIG. 1 is a perspective view of one form of self-supporting funnel according to the invention.
Figure 3:
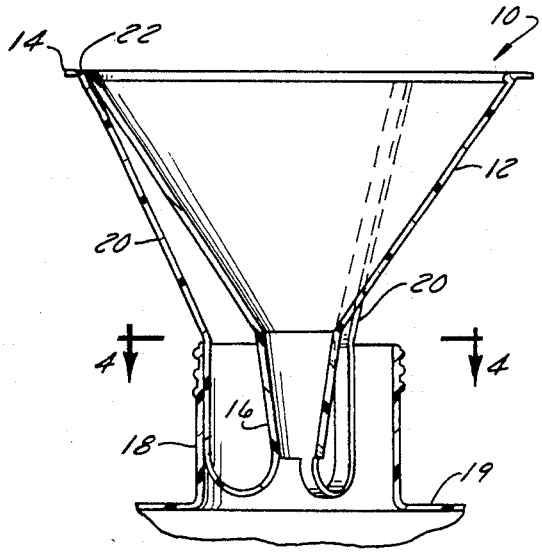
FIG. 3 is a view taken on line 3—3 of FIG. 2 showing the funnel in the opening of a vessel.

Means are provided around the outside of the funnel for supporting the funnel in a coaxial relation in the neck 18 of the tank 19. Such means is in the form of three straps 20. The straps 20 can be molded as an extension to the bottom of the spout 16 and, as seen in FIG. 1, are turned upward with the upper ends of the straps 20 being secured to the body 12 immediately below the flange 14. The upper ends may be secured to the outside surface of the body by any appropriate means such as an adhesive or mechanically locked into openings 22 (FIG. 3) in the flange 14. The straps 20 will then assume a bowed configuration and are spaced outwardly with respect to the sides of the funnel body 12 and spout 16. When inserted into the opening in the neck 18 of the tank 19, the straps 20 will be deflected inwardly as the funnel is pushed into the opening in the neck 18 until the straps 20 are firmly wedged into the opening in the neck 18. Three straps 20 are provided on the funnel to provide an even distribution of force to support the funnel in an upright position as well as an air space around the outside of the spout.

Figure 5:
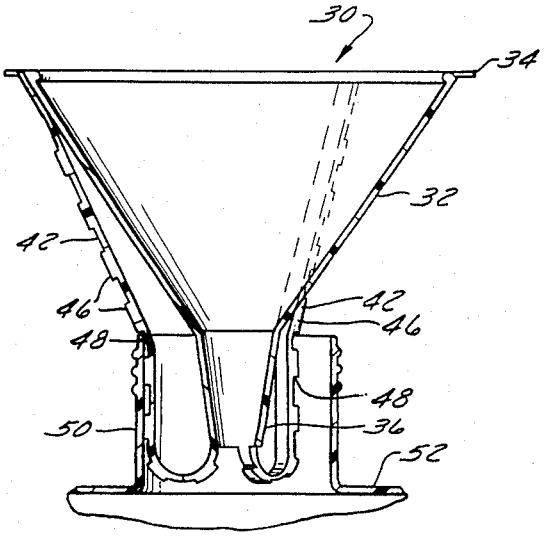
FIG. 5 is a view of an alternate embodiment of the invention having straps with mechanical interlock notches.
Figure 4:
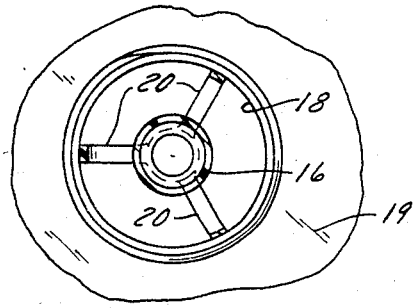
FIG. 4 is a view taken on line 4—4 of FIG. 3 showing the disposition of the supporting straps of the funnel.

In the alternate embodiment of the invention shown in FIG. 5, a funnel 30 is shown having a main body 32 and a flange 34 around the upper edge of the main body 32. A spout 36 is provided at the lower end of the conical body 32. Straps 42 are provided around the outside of the funnel which are secured to the flange 34 at the upper end and are formed integrally with the lower end of the spout 36. The straps 42 are provided with means for mechanically interlocking the strap 42 with the edge of the opening in the neck 18 in the tank 19. Such means is in the form of a series of notches 46 which are located at equal distances along the outside surface of the straps 42. With this arrangement, the funnel 30 will be supported on three sides on engagement of the notches 46 with the edge of the opening in the bottle. It should be noted that the notches provide the ability to support the funnel in a generally vertical relation to an angularly offset neck of a tank.

In this regard and referring to FIG. 5, it should be noted that the funnel 30 is supported by the straps 42 in a vertical relation to the neck 50 of a tank 52. This is due to the provision of a positive step 48 in each strap which is formed by the perpendicular relation of the notches 46 to the straps 42. The notches 46 provide the stability to hold the funnel in a generally vertical relation to the angularly offset opening in the neck of a fuel tank. This is accomplished by inserting the spout vertically into the offset opening until one of the steps 48 in each of the straps engage the edge of the opening preventing any further movement of the funnel into the opening in the neck 50 of the tank 52.

The embodiments of the invention in which an exclusive property or privilege is claimed are defined as follows:

1. A funnel comprising a conical body having a spout formed integrally with the narrow end of said body, means provided around the outer periphery of said body for supporting said body in the opening in the neck of a tank, said means including three flexible straps, one end of each strap being connected to the top of said body and the other end of each of said straps being connected to the bottom of said spout, said straps being spaced from said body and spout throughout their length to provide sufficient flexibility to support the funnel in the neck of a tank.

2. The funnel according to claim 1 wherein said straps are formed integrally with the bottom end of said spout and are bowed outward by connecting the end of the straps to the upper end of said body.

3. The funnel according to claim 1 wherein each strap includes a plurality of notches on the outer surface whereby said funnel can be supported in a vertical relation in the opening of an angularly disposed neck for a tank.

4. The funnel according to claim 2 wherein said straps include a plurality of equally spaced notches on the outer surface thereof whereby said funnel will be supported in a vertical relation to the opening in an angularly disposed neck in a fuel tank.

5. A funnel comprising a conical body having an opening at the narrow end, a spout formed integrally with the narrow end of said conical body, and three flexible straps equally spaced around said conical body, each strap having one end secured to the top of said conical body and the other end secured to the bottom of said spout, each strap including a series of equally spaced notches forming steps whereby said funnel can be supported in a vertical relation in the opening of an angularly offset neck of a tank.

* * * * *